US006567991B1

(12) United States Patent
Holslag et al.

(10) Patent No.: US 6,567,991 B1
(45) Date of Patent: May 27, 2003

(54) PERSPIRATION CONTROL DEVICE HAVING PERSPIRATION DIRECTING SEAL STRIP

(76) Inventors: Nicholas J. C. Holslag, 4660 LaJolla Village Dr. #1100, San Diego, CA (US) 92122; Paul D. Ketchen, 12543 Heatherton Ct. #184, San Diego, CA (US) 92128

( * ) Notice: Subject to any disclaimer, the term of this patent is extended or adjusted under 35 U.S.C. 154(b) by 0 days.

(21) Appl. No.: 10/013,604

(22) Filed: Dec. 12, 2001

Related U.S. Application Data

(60) Provisional application No. 60/254,836, filed on Dec. 11, 2000.

(51) Int. Cl.[7] ..... A42C 5/00

(52) U.S. Cl. ..... 2/181.4; 2/171

(58) Field of Search ..... 2/181.4, 410, 422, 2/10, 171, 181, 181.6, 182.3, 209.12, 181.8

(56) References Cited

U.S. PATENT DOCUMENTS

| | | | | | |
|---|---|---|---|---|---|
| 2,320,782 | A | * | 6/1943 | Larsen | 2/171 |
| 4,021,859 | A | | 5/1977 | Burke | 2/197 |
| 4,368,545 | A | * | 1/1983 | Seidman | 2/174 |
| 4,393,519 | A | | 7/1983 | Nicastro | 2/12 |
| 4,521,922 | A | * | 6/1985 | Mitchell et al. | 2/170 |
| 4,547,903 | A | | 10/1985 | Brown et al. | 2/12 |
| 4,626,247 | A | * | 12/1986 | Frankel | 2/181.8 |
| 4,638,512 | A | * | 1/1987 | Frankel | 2/171 |
| 4,856,116 | A | | 8/1989 | Sullivan | 2/181 |
| 5,640,721 | A | * | 6/1997 | Jackson | 2/171 |
| 5,740,556 | A | | 4/1998 | Brown | 2/181 |
| 5,781,932 | A | | 7/1998 | Brown | 2/181 |
| 5,826,277 | A | * | 10/1998 | McConville | 2/171 |
| 5,887,284 | A | * | 3/1999 | Simmons | 2/181 |
| 6,026,518 | A | | 2/2000 | Brown | 2/439 |

* cited by examiner

*Primary Examiner*—Gary L. Welch
(74) *Attorney, Agent, or Firm*—Flanagan & Flanagan; John R. Flanagan

(57) ABSTRACT

A perspiration control device includes a headband having opposite outer and inner sides and opposite front and back portions, and at least one elongated seal strip applied on the inner side of the front portion of the headband and having opposite ends such that the seal strip will cross a forehead of a user when the headband is worn by the user and the seal strip will function to direct perspiration toward the opposite ends of the strip and thus toward opposite sides of the forehead and beyond eyes of the user.

13 Claims, 3 Drawing Sheets

PERSPIRATION CONTROL DEVICE HAVING PERSPIRATION DIRECTING SEAL STRIP

This patent application claims the benefit of U.S. provisional application No. 60/254,836, filed Dec. 11, 2000.

BACKGROUND OF THE INVENTION

Field of the Invention

The present invention generally relates to perspiration control devices and, more particularly, is concerned with a perspiration control device in the form of a headband having a water tight seal strip on an inner side of the headband for directing perspiration toward opposite ends of the strip.

Description of the Prior Art

It is a common practice for individuals engaged in strenuous activity such as jogging, basketball, tennis and other racket sports to wear perspiration control devices in the form of absorbent headbands. These headbands usually include an elasticized cotton material which is adapted to encircle the head of the user to absorb perspiration primarily on the brow of the user and to prevent droplets of perspiration from coming into contact with the eyes of the user. However, after a time these headbands will become saturated with perspiration and it will then start to drip and run down the user's forehead into his or her eyes.

Representative examples of perspiration control devices proposed in the prior art are those discloses in U.S. Pat. No. 4,021,859 to Burke, U.S. Pat. No. 4,393,519 to Nicastro, U.S. Pat. No. 4,547,903 to Brown et al., U.S. Pat. No. 4,856,116 to Sullivan, U.S. Pat. No. 5,740,556 to Brown, U.S. Pat. No. 5,781,932 to Brown, and U.S. Pat. No. 6,026,518 to Brown. While these prior art perspiration control devices may be satisfactory in use for the specific purposes for which they were designed, none of them seem to provide an effective solution for the problem at hand.

Consequently, a need still exists for an innovation which will provide an effective solution to the aforementioned problem in the prior art without introducing any new problems in place thereof.

SUMMARY OF THE INVENTION

The present invention provides a perspiration control device designed to satisfy the aforementioned need. The perspiration control device of the present invention includes a headband which can be either an article of apparel worn on the head of a user as a standalone component or a component of an article of apparel, such as a ballcap, worn on the head of the user. In either application, the headband has a water tight seal strip on an inner or back side of the headband which functions to direct perspiration toward opposite ends of the strip. Thus, the objective of the perspiration control device of the present invention is primarily not to absorb perspiration but to direct it away from the eyes of a user which are located below the strip.

Accordingly, the present invention is directed to a perspiration control device which comprises: (a) a headband having opposite outer and inner sides and opposite front and back portions; and (b) at least one elongated seal strip applied on the inner side of the front portion of the headband and having opposite ends such that the seal strip will cross a forehead of a user when the headband is worn by the user and the seal strip will function to direct perspiration toward the opposite ends of the seal strip and thus toward opposite sides of the forehead and beyond eyes of the user.

The present invention also is directed to an article of apparel which comprises: (a) a cap portion for wearing on a head of a user so as to substantially cover an upper portion of the head; and (b) a perspiration control portion attached on the cap portion, the perspiration control portion including (i) a headband having opposite outer and inner sides and opposite front and back portions, and (ii) an elongated seal strip applied on the inner side of the front portion of the headband and having opposite ends such that the seal strip will cross a forehead of a user when the article of apparel is worn by the user and the seal strip will function to direct perspiration toward the opposite ends of the seal strip and thus toward opposite sides of the forehead and beyond eyes of the user.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
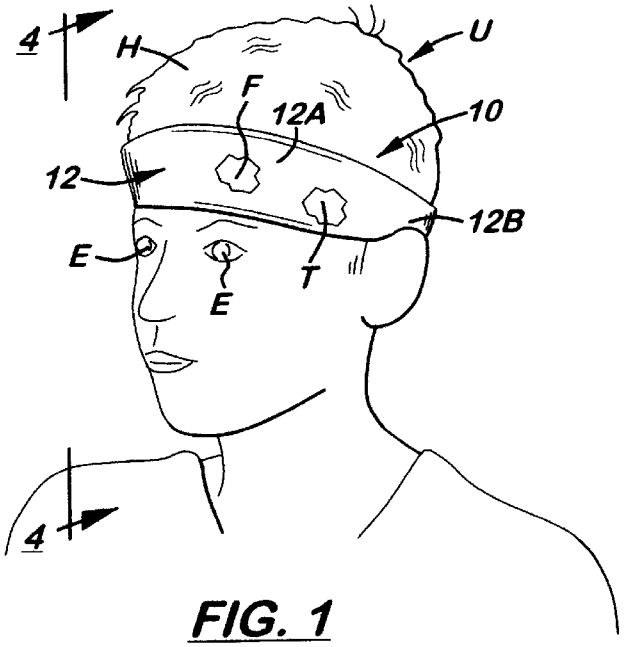
FIG. 1 is a front perspective view, from shoulders up, of a user wearing a perspiration control device of the present invention in the form of a standalone article of apparel worn about the head of the user and across the forehead region of the head.
Figure 7:
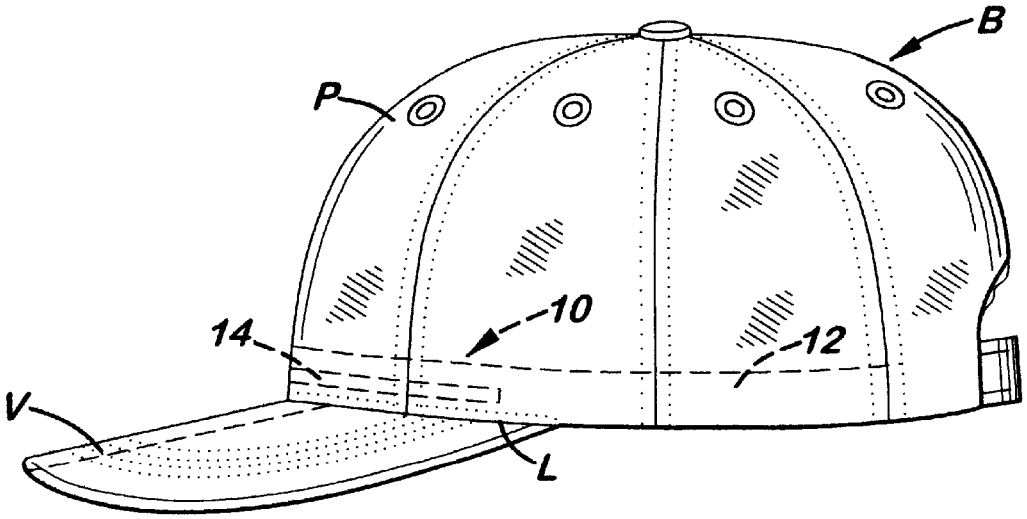
FIG. 7 is a side elevational view of the perspiration control device of the present invention incorporated as a component of an article of apparel in the form of a ballcap worn on the head of the user.
Figure 8:
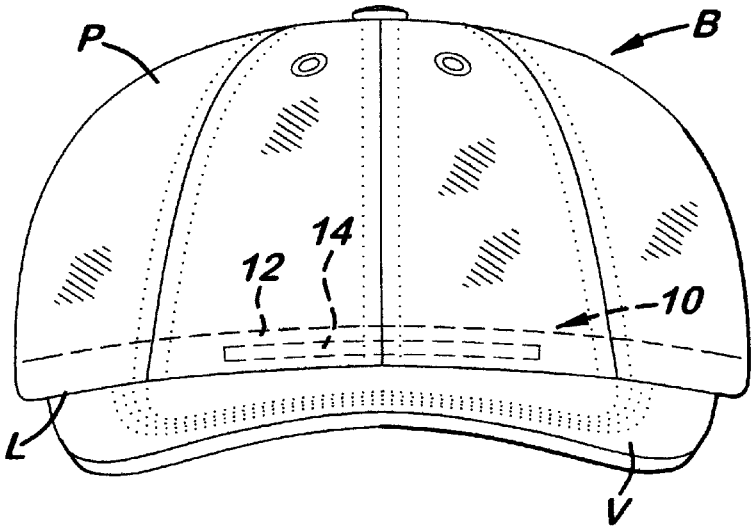
FIG. 8 is a front elevational view of the device and ballcap of FIG. 7.

Referring to the drawings and particularly to FIGS. 1 to 5, there is illustrated a perspiration control device, generally designated 10, of the present invention. The perspiration control device 10 basically includes a headband 12 which can be either an article of apparel worn on a head H of a user U as a standalone component, as seen in FIG. 1, or a component of an article of apparel, such as a conventional ballcap B, as seen in FIGS. 7 and 8. In both applications, in addition to the headband 12 the device 10 also includes at least one water tight seal strip 14 applied on an inner side 16 of front portion 12A of the headband 12 that crosses the forehead F of the user U so as to function to direct perspiration toward opposite ends 14A of the strip 14 and thus toward opposite sides of the forehead beyond the eyes E of the user U. The outer side 18 of the headband 12 can have a design or indicia printed thereon.

Figure 2:
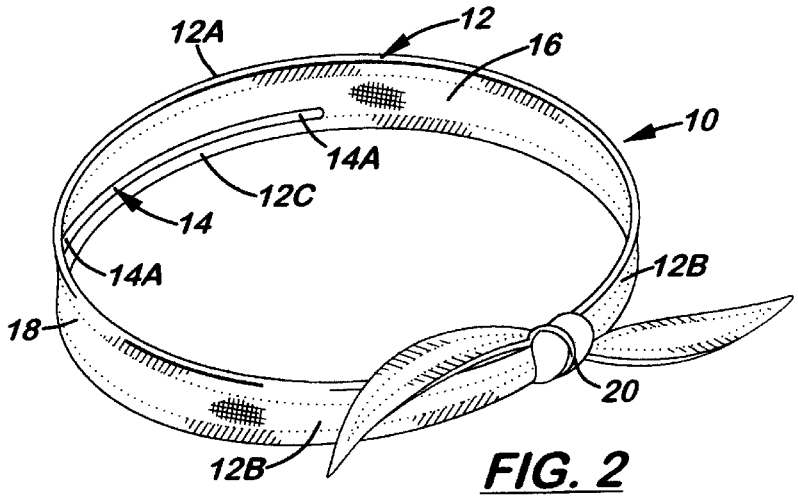
FIG. 2 is a rear perspective view of a first embodiment of the device of FIG. 1 removed from the head of the user.
Figure 3:
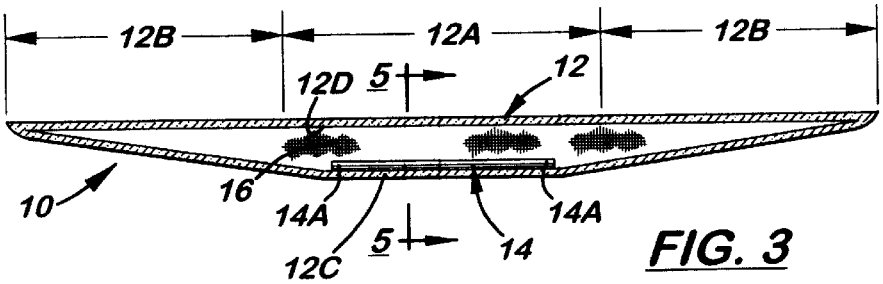
FIG. 3 is a rear layout view of the device of FIG. 2.
Figure 4:
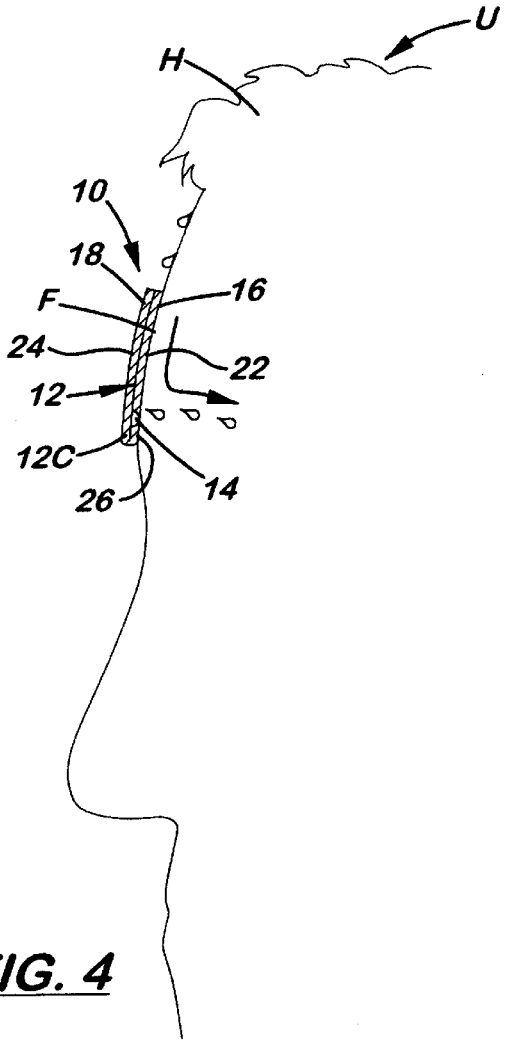
FIG. 4 is an enlarged side elevational view as seen along line 4—4 of FIG. 1 with the device shown in a vertical cross-sectional form.
Figure 5:
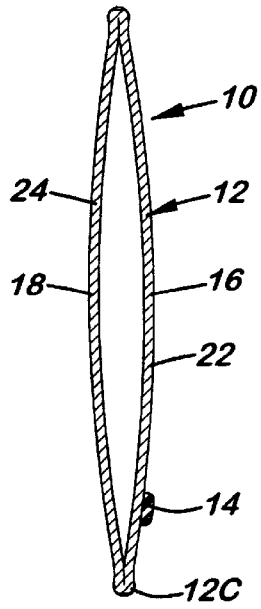
FIG. 5 is an enlarged vertical cross-sectional view of the device taken along line 5—5 of FIG. 3.

Referring to FIGS. 1–6, the headband 12 is a sweat control device which is worn on the user's head H, as seen in FIG. 1. The headband 12, as seen in FIGS. 2 and 3, has a back portion 12B constructed of a common material with the front portion 12A and providing elongated ends which are continuous extensions from opposite ends of the front portion such that the elongated ends are adapted to be tied in a knot 20 in the back for a snug fit. Alternatively, as seen in FIG. 1, the front and rear portions 12A, 12B of the headband 12 can be of continuous construction and of a common material suitably elastic such that the headband 12 is easily slipped over the head. The headband 12 has two layers forming inner and outer layers 22, 24 when the headband 12 is positioned on the user's head H, as seen in FIGS. 4 and 5.

The strip 14 forms the water tight seal 26 against the skin it contacts on the user's head H. When properly worn, the water tight seal 26 is formed between the user's forehead F and the headband 12, as seen in FIG. 4. Any perspiration or sweat that forms on the forehead F of the user U is directed to move left and/or right pass the opposite ends 14A of the strip 14 and beyond or away from the eyes E toward the temples T. The material used to fabricate the headband 12 and strip 14 of the device 10 are flexible and have elastic properties that work cooperatively together for providing a one-size-fits-all capability. In addition, materials are used in the two layers 22, 24 of the headband 12 to absorb and wick away perspiration.

As seen in FIG. 3, as one example the headband 12 can be approximately 2 inches wide and 29 inches long. The headband 12 also has bottom and top edges 12C, 12D such that the bottom edge 12C of the headband 12 begins to taper up toward the top edge 12D about 3½ inches from the center of the headband 12 in both directions. The inner layer 24 is in contact with the user's skin. The inner and outer layers 22, 24 are the same size and are sewn together around their peripheries, as seen in FIGS. 2, 3 and 5.

The seal strip 14, which can be made of polyvinyl material, is attached to and extends along the inner layer 22 at the inner side 18 of the headband 12. The seal strip 14 is the key component and can be applied by a known silk-screening process. The material of the seal strip 14 preferably has a non-slip characteristic which keeps the headband 12 or other gear in place on the head H. The seal strip 14 is centered lengthwise on inner side 16 of the headband 12 and along the bottom edge 12C thereof, about ¼ inch from the base of the headband 12. As an example, the seal strip 14 is approximately 7 inches long, ¼ inch wide and ⅛ inch in depth. As seen in FIG. 5, the seal strip 14 has a solid cross-sectional configuration and externally is of a semi-round or rounded shape, although it can have other configurations, such that the strip 14 protrudes outwardly from the front portion 12A of the headband 12.

Figure 6:
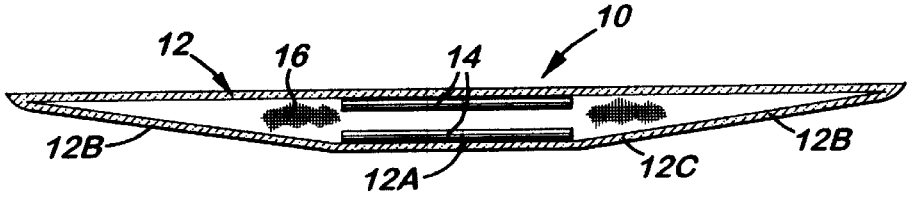
FIG. 6 is a rear layout view of a second embodiment of the device of the present invention.

All materials of the headband 12 and seal strip 14 of the device 10 can be washed and dried normally with no apparent problems beyond normal wear and tear. The headband 12 can be provided in different sizes. Also, as seen in FIG. 6 where two strips 14 are shown on the headband 12, it can be readily understood that the strips 14 can vary in size and number.

Referring to FIGS. 7 and 8, the headband 12 and seal strip 14 of the device 10 are shown incorporated as a component of a conventional ballcap B. Basically, the cap B includes a crown or cap portion P contoured for covering a part of the user's head H when the cap B is worn, and a visor V disposed exteriorly of and attached to the crown P at a lower front edge L thereof such that the visor V extends outwardly from the crown P. The headband 12 can be the normal sweat control band of the cap B which is disposed interiorly of the crown P and attached along the lower edge L thereof. The sweat control band now has the seal strip 14 applied on the inner side thereof. In all other respects the device 10 has substantially the same construction and function as in the embodiment of the device 10 shown in FIGS. 1–6. It will be understood that the cap can take many different forms. For example, one form is a skull cap such as worn under a football helmet.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A perspiration control device, comprising:

(a) a headband having opposite outer and inner sides, bottom and top edges and opposite front and back portions, said front and back portions being constructed of a common material such that said back portion is a pair of elongated ends which are continuous extensions from opposite ends of said front portion on which said elongated ends one of said bottom and top edges of said headband tapers toward the other of said bottom and top edges so as to provide said elongated ends with tapered configurations adapting said ends to be tied in a knot in order to snugly fit said headband about the head of the user; and (b) at least one elongated seal strip applied on and extending along said inner side of said front portion of said headband and disposed between said elongated tapered ends of said headband, said seal strip having a solid cross-sectional configuration which externally is of rounded shape and protrudes outwardly from said front portion of said headband such that said seal strip is adapted to form a water tight seal between said headband and the forehead of the user, said seal strip having opposite ends disposed adjacent to said opposite ends of said front portion of said headband such that said seal strip and said front portion of said headband will cross and contact a forehead of a user when said headband is worn by the user and said seal strip will function to direct perspiration toward said opposite ends of said seal strip and thus toward opposite sides of the forehead and beyond eyes of the user.

2. The device of claim 1 wherein said headband is made of a material that is suitably elastic such that said headband can be slipped over the head of the user.

3. The device of claim 1 wherein said headband has two separate layers being attached to one another along peripheries thereof so as to form inner and outer layers when said headband is positioned on the head of the user, said seal strip being applied on said inner layer of said headband which defines said inner side of said headband.

4. The device of claim 1 wherein said seal strip is fabricated of a flexible material.

5. The device of claim 1 wherein said headband and said seal strip are fabricated of respective materials that are flexible and have elastic properties that work cooperatively together such that said device has a one-size-fits-all capability.

6. The device of claim 1 further comprising two seal strips applied on said headband with one of said seal strips being spaced above the other of said seal strips.

7. The device of claim 1 wherein said seal strip is made of polyvinyl material.

8. An article of apparel, comprising:

(a) a cap portion for wearing on a head of a user so as to substantially cover an upper portion of the head, said cap portion having an inside bottom marginal edge; and (b) a perspiration control portion attached on said cap portion, said perspiration control portion including (i) a headband having a bottom edge, opposite outer and inner sides and opposite front and back portions and being attached along said inside bottom marginal edge of said cap portion, and (ii) an elongated seal strip applied on and along said inner side of said front portion of said headband and spaced above said bottom edge thereof, said seal strip having a solid cross-sectional configuration which externally is of rounded shape and protrudes outwardly from said front portion of said headband such that said seal strip is adapted to form a water tight seal between said headband and the forehead of the user, said seal strip having opposite ends such that said seal strip and said front portion of said headband will cross and contact a forehead of a user when said article of apparel is worn by the user and said seal strip will function to direct perspiration toward said opposite ends of said seal strip and thus toward opposite sides of the forehead and beyond eyes of the user.

9. A perspiration control device, comprising:

(a) a headband having opposite outer and inner sides and opposite front and back portions, said headband comprising two separate layers being attached to one another along peripheries thereof so as to form inner and outer layers when said headband is positioned on the head of the user; and (b) at least one elongated seal strip applied on and along, said inner layer of said headband at said inner side of said front portion of said headband, said seal strip having a solid cross-sectional configuration which externally is of rounded shaped and protrudes outwardly from the headband such that the strip is adapted to form a water tight seal between said headband and the forehead of the user, said seal strip having opposite ends disposed adjacent to said back portion of said headband such that said seal strip and said front portion of said headband will cross and contact a forehead of a user when said headband is worn by the user and said seal strip will function to direct perspiration toward said opposite ends of said seal strip and thus toward opposite sides of the forehead and beyond eyes of the user.

10. The device of claim 9 wherein said seal strip is fabricated of a flexible material.

11. The device of claim further comprising two seal strips applied on and along said inner layer of said headband at said inner side of said front portion of said headband with one of said seal strips being spaced above the other of said seal strips.

12. The device of claim wherein said seal strip is made of polyvinyl material.

13. A perspiration control device, comprising:

(a) a headband having opposite outer and inner sides, bottom and top edges and opposite front and back portions, said front and back portions being constructed of a common elastic material and continuous in construction with one another such that said headband will snugly fit about the head of the user; and (b) at least one elongated seal strip applied on and extending along said inner side of said front portion of said headband and spaced from said back portion of said headband, said seal strip having a solid cross-sectional configuration which externally is of rounded shape and protrudes outwardly from said front portion of said headband such that said seal strip is adapted to form a water tight seal between said headband and the forehead of the user, said seal strip being disposed adjacent to said front portion of said headband such that said seal strip and said front portion of said headband will cross and contact a forehead of a user when said headband is worn by the user and said seal strip will function to direct perspiration toward said opposite ends of said seal strip and thus toward opposite sides of the forehead and beyond eyes of the user.

* * * * *